United States Patent [19]

Hemmeter

[11] Patent Number: 4,712,300

[45] Date of Patent: Dec. 15, 1987

[54] SPONGE-BLOCK SAFETY RAZOR HOLDER

[76] Inventor: George T. Hemmeter, 4125 Black Point Rd., Honolulu, Hi. 96816

[21] Appl. No.: 920,417

[22] Filed: Oct. 20, 1986

[51] Int. Cl.[4] ..... B26B 19/44

[52] U.S. Cl. ..... 30/41; 30/85; 30/41.5

[58] Field of Search ..... 30/41, 41.5, 85, 86, 30/89

[56] References Cited

U.S. PATENT DOCUMENTS 3,750,280 8/1973 Le Paliscot et al. ..... 30/85

3,821,851 7/1974 Kuhnl ..... 30/85

*Primary Examiner*—Paul A. Bell

*Assistant Examiner*—William Fridie, Jr.

[57] ABSTRACT

This invention is a safety razor-blade holder consisting of a block of sponge-like material that is semi-rigid when dry and flacid when wet in which a conventional razor-blade assembly is implanted. The cutting edge or edges of the razor blades are preferably on or slightly below the surface of the sponge-block. When the wet sponge-block assembly is pressed lightly on the skin surface to be shaved, and moved in the direction indicated by the shape of the sponge-block, shaving occurs. It is particularly suitable for shaving arms, underarms, legs and body areas. No previous operational skill is necessary to shave satisfactorily.

5 Claims, 6 Drawing Figures

SPONGE-BLOCK SAFETY RAZOR HOLDER

BACKGROUND OF THE INVENTION

This invention is a new type of razor bladeholder, consisting of a semi-rigid, sponge-block when dry, in which a conventional razor blade assembly is implanted. The razor sponge-block is flacid when wet.

This invention relates to a novel method of a holder for a safety razor blade device, to make it easy to shave the legs, arms, and body, even though the operator has had no previous experience or is not ambidextrous.

DESCRIPTION OF PRIOR ART

There are several types of safety razors in common use. They consist essentially of a handle that holds the blade, or blades, which are located at one extremity, and at right angles to the said handle. The cutting edge or edges of said blades are faced in the direction of the cutting that is to be done.

During shaving, the handle is held nearly perpendicular to the skin. When shaving many areas on the body, especially the back of the legs or under the arms, it may be difficult to hold the handle of a conventional razor perpendicular to the skin. This is true even with the aid of a mirror.

Some razor-blade holders mount the blades privotably to assist the operator to automatically adjust the blade to the proper cutting angle. At best, a person using a traditonal razor to shave the legs, body, arms, under the arms, or other parts of the body, will find it very difficult, and one needs practice to do a proper job.

OBJECT OF THE INVENTION

An object of this invention is to produce a razor blade holder that enables a novice to do a satisfactory job of shaving the arms, legs, body or under the arms without practice.

Another object is to produce a razor that can safely be stored or transported without using a carrying case.

Another object of this invention is to produce a marketable blade mount that will appeal to women who shave their legs and arms diligently.

Another object of this invention is to produce a blade holder that is easy to mass produce.

Another object is to produce a razor blade holder that has eye appeal and tempt one to try this radical departure from the norm.

Another object of this invention is to produce a razor blade holder that is safe and easy to store and one that can be used with scant danger of cutting oneself.

Still another object of this invention is to provide for a sponge-block in various colors so the individual family member can identify their razor by color.

METHOD OF OPERATION

This invention is a new and novel type of safety razor blade holder. It consists essentially of a block of semi-rigid sponge-like substance in which a safety-razor blade assembly is implanted. This type of razor blade assembly is marketed by several companies throughout the United States.

The cutting edges of the blade or blades are located on or slightly below the block-sponge surface and faced in the direction of shaving.

In preparation for shaving the sponge-block is wet with water whereupon it becomes flacid. The skin to be shaved is washed with soap and warm water.

The shaver is then placed gently on the skin surface to be shaved with the cutting blade or blades near the skin. By applying a slight pressure on the sponge-block, it is compressed and allows contact of the blades with the skin. Stroke the surface once or until the hairs are properly removed. Occasionally the hair cuttings should be flushed from the razor blade assembly through scavenging ports provided for that purpose.

After shaving the sponge-block should be hand squeezed to remove excess water and then stood upright on feet located on the bottom side of the razor. This will allow rapid drying and will also protect the blade from damage when stored.

It will be noted that the direction of movement of the razor to shave is indicated by the arrow shape of the plan surface of the sponge-block. It is not necessary to lift the razor off of the skin on the back stroke during shaving.

DESCRIPTION OF PREFERRED EMBODIMENT

Before explaining the present invention in detail, it is to be understood that this invention is not limited in its application to the details of construction and arrangements of parts illustrated in the accompanying drawings, and the specification of materials in use, since the invention is capable of other embodiments, and of being practiced or carried out in various ways.

Also, it is to be understood that the phraseology or terminology employed herein is for the purpose of description and not limitation.

Figure 1:
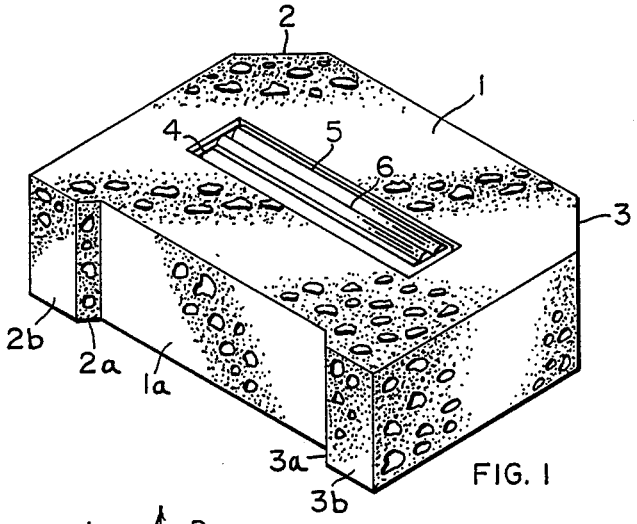
FIG. 1 is a perspective view of a complete sponge-block razor blade holder.

FIG. 1 shows a perspective view of the razor assembly. No. 1 is a block of sponge-like material which is semi-stiff when dry, and flacid when wet. The sponge block edges 2 and 3, are formed as the sides of an arrow and are pointed to indicate the direction, D, of movement, and cutting.

The indentation *2a* and *3a* form the directional tail of the cutting motion indicator. Areas *2b* and *3b* form two legs to stand the razor in an upright position when the razor is not in use, and to quicken drying.

Figure 2:
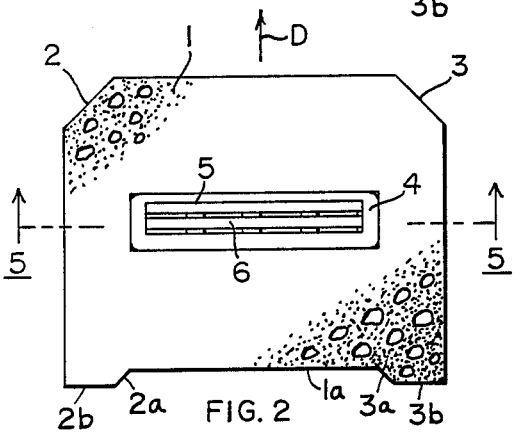
FIG. 2 is a plan view of the sponge-block razor-blade holder showing the direction "D" for cutting.
Figure 3:
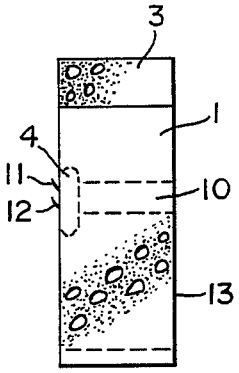
FIG. 3 is a side view of the system with the blade protruding slightly above the surface of the sponge-block (for directional clarity only).
Figure 4:
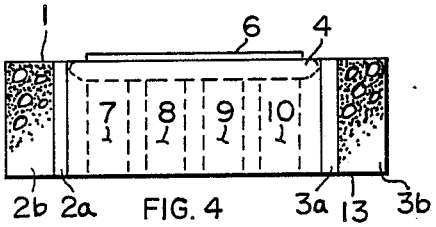
FIG. 4 is a bottom-side view of the sponge-block showing the feet and the implanted razor blade assembly with the cutting edge of the blades protruding slightly above the surface of the sponge-block (for directional clarity only).
Figure 5:
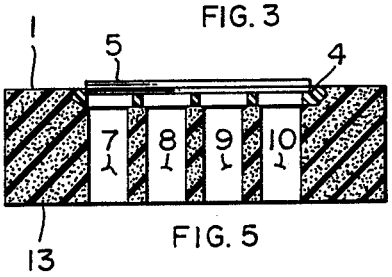
FIG. 5 is a sectional view 5—5 to show the scavenging ports in the sponge-block communicating with the like purpose ports in the razor-blade assembly.
Figure 6:
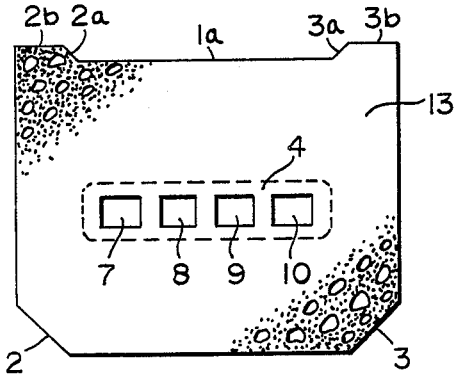
FIG. 6 is a bottom plan view of the sponge-block showing the scavenging ports.

No. 4 is a razor-blade assembly as manufactured by several companies and marketed for use in conventional safety razor handles previously described. 5 and 6 are cutting edges of the said razor-blades. 7, 8, 9, and 10 are flushing ports that communicate with similar purpose ports in the said blade assembly, and run through the sponge-block as shown in sectional view FIG. 5. Their purpose is to form an exit or path for the shavings to be flushed from the system. For purpose of identification only 11 and 12 of FIG. 3 show the cutting edges of the blades portruding above the surface of the sponbe-block. They are actually located flush, or slightly below the surface of the sponge-block to shave satisfactorily without danger of cutting. The resiliency of the sponge-block when wet, will allow the blades to contact the skin. The lower edge, 1*a*, of the sponge-block, is indented to make the plan view of the sponge-block more nearly like a pointer to indicate the direction of shaving as D in FIG. 2.

when in use as a shaver, the skin to be shaved is washed with soap and warm water. Also, the sponge-block razor holder is wet. The bladed surface 1 of the shaver is lightly pressed down upon the skin surface to be shaved and the assembly is glided in the direction indicated by the pointer on 1. Repeat by gliding back and forth until the surface to be shaved is hairless. Sponge-block surface 13 is away from the skin at all times.

When shaving is completed the unit is flushed clean and the excess water is squeezed from the sponge-block by hand. The shaver is stood on feet 2*b* and 3*b* for drying. No container is required for storage, as the blades shaving-edges are preferably located below the sponge-block surface and thus are adequately protected.

I claim as my invention:

1. A safety razor blade holder constructed of a block of sponge material which is semi-stiff when dry and flacid when wet, said sponge-block supports a conventional razor-blade assembly having at least one cutting blade implanted within said sponge block with the cutting edge of said at least one blade located on or slightly below a plane established by the surface of the sponge-block oriented and to shave when said sponge-block with said at least one blade is pressed lightly on the skin until the cutting edge of the blade or blades are in contact with the skin and stroked in the direction of cutting or shaving.

2. In claim 1 wherein means are provided on to indicate the direction of movement for shaving.

3. In claim 2 in which said sponge-block is manufactured in various colors for individual identification.

4. In claim 1 wherein said sponge-block is perforated with at least one scavenging port interconnected with like purpose ports in said razor blade assembly to facilitate flushing of hair cutting from the system.

5. In claim 1, wherein said sponge-block is shaped to stand on end to facilitate drying when standing in an upright position.

* * * * *